US010696040B2

(12) United States Patent
Settele et al.

(10) Patent No.: US 10,696,040 B2
(45) Date of Patent: Jun. 30, 2020

(54) LITHO STRIP WITH HIGH COLD-ROLLING PASS REDUCTION

(71) Applicants: Christoph Settele, Mönchengladbach (DE); Bernhard Kernig, Köln (DE); Jochen Hasenclever, Bonn (DE); Gerd Steinhoff, Bonn (DE)

(72) Inventors: Christoph Settele, Mönchengladbach (DE); Bernhard Kernig, Köln (DE); Jochen Hasenclever, Bonn (DE); Gerd Steinhoff, Bonn (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 16/165,424

(22) Filed: Oct. 19, 2018

(65) Prior Publication Data

US 2019/0047279 A1 Feb. 14, 2019

Related U.S. Application Data

(63) Continuation of application No. PCT/EP2017/059261, filed on Apr. 19, 2016.

(30) Foreign Application Priority Data

Apr. 20, 2016 (EP) ..... 16166182

(51) Int. Cl.
*C22F 1/04* (2006.01)
*B21B 3/00* (2006.01)
(Continued)

(52) U.S. Cl.
CPC ..... *B41C 1/1075* (2013.01); *B41N 1/083* (2013.01); *C22C 21/00* (2013.01); *C22F 1/04* (2013.01); *B21B 2003/001* (2013.01)

(58) Field of Classification Search
CPC .. C21D 8/0236; C21D 8/0268; C21D 8/0436; C21D 8/0468; C21D 8/1233;
(Continued)

(56) References Cited

U.S. PATENT DOCUMENTS 3,397,044 A * 8/1968 Bylund ..... B21D 22/201 428/583
3,571,910 A 3/1971 Bylund
5,350,010 A 9/1994 Sawada et al.

FOREIGN PATENT DOCUMENTS

CN 101182611 B 10/2010
CN 102308011 A 1/2012
(Continued)

*Primary Examiner* — Vanessa T. Luk
(74) *Attorney, Agent, or Firm* — Reinhart Boerner Van Deuren P.C.

(57) ABSTRACT

Provided is a method for production of an aluminium strip for lithographic printing plate supports from an aluminium alloy including (in wt %): 0.05%≤Si≤0.25%, 0.2%≤Fe≤1%, Cu max. 400 ppm, Mn≤0.30%, 0.10%≤Mg≤0.50%, Cr≤100 ppm, Zn≤500 ppm, Ti<0.030%, the remainder aluminium and unavoidable impurities individually at most 0.03%, in total at most 0.15%. In the method, a rolling ingot is cast from an aluminium alloy, and the rolling ingot is homogenised. Further, the rolling ingot is hot rolled to a hot strip final thickness, and the hot strip is cold rolled to final thickness of between 0.1 mm and 0.5 mm. The product of the relative final thicknesses of the aluminium strip after the first and after the second cold rolling pass of the aluminium strip is 15% to 24%.

12 Claims, 3 Drawing Sheets

(51) Int. Cl.
*C22C 21/00* (2006.01)
*B41C 1/10* (2006.01)
*B41N 1/08* (2006.01)

(58) Field of Classification Search
CPC ..... C21D 8/1266; C22F 1/04; C22F 1/043; C22F 1/047; C22F 1/05; B21B 2003/001; B41N 1/083
See application file for complete search history.

(56) References Cited

FOREIGN PATENT DOCUMENTS

| | | | |
|---|---|---|---|
| CN | 103380007 | A | 10/2013 |
| CN | 105170652 | A | 12/2015 |
| DE | 699 20 831 | T2 | 11/2005 |
| EP | 2 192 202 | A1 | 6/2010 |
| JP | 11-61364 | A | 3/1999 |
| JP | 11-229101 | A | 8/1999 |
| JP | 2000-17412 | A | 1/2000 |
| JP | 2000-96172 | A | 4/2000 |
| JP | 2004-515652 | A | 5/2004 |
| JP | 2009-512780 | A | 3/2009 |
| JP | 2011-505493 | A | 2/2011 |
| JP | 2012-509404 | A | 4/2012 |
| WO | WO 2010057959 | A1 | 5/2010 |

* cited by examiner

LITHO STRIP WITH HIGH COLD-ROLLING PASS REDUCTION

CROSS-REFERENCE TO RELATED PATENT APPLICATIONS

This patent application is a continuation of PCT/EP2017/059261, filed Apr. 19, 2017, which claims priority to European Application No. 16166182.2, filed Apr. 20, 2016, the entire teachings and disclosure of which are incorporated herein by reference thereto.

FIELD

The invention concerns a method for production of an aluminium strip for lithographic printing plate supports from an aluminium alloy, wherein the aluminium alloy of the aluminium strip for lithographic printing plate supports comprises the following alloy constituents in % by weight:

0.05%≤Si≤0.25%,
0.2%≤Fe≤1%,
Cu max. 400 ppm,
Mn≤0.30%,
0.10%≤Mg≤0.50%
Cr≤100 ppm,
Zn≤500 ppm,
Ti<0.030%, the remainder aluminium and unavoidable impurities individually at most 0.03%, in total at most 0.15%, with at least the following steps:

casting of a rolling ingot from an aluminium alloy,
homogenising of the rolling ingot,
hot rolling of the rolling ingot to a hot strip final thickness, and
cold rolling of the hot strip to final thickness, wherein the final thickness after cold rolling is between 0.1 mm and 0.5 mm.

BACKGROUND

Aluminium strips must fulfil a plurality of requirements simultaneously in order to provide an adequate quality for lithographic printing plate supports. One of the most important properties of the aluminium strip, which must be fulfilled, is homogenous behaviour in an electrochemical roughening. A superficial roughening of the aluminium strip must lead to an unstructured appearance of the aluminium strip with no streakiness effects. A photosensitive layer is applied to the roughened structure, which depending on the type of application, is burned in after application at a temperature of 220° C. to 300° C. for between 3 and 10 minutes. Typical combinations of burn-in times are for example 240° C. for 10 minutes, 260° C. for 6 minutes, 270° C. for 7 minutes, and 280° C. for 4 minutes. The strength loss of the printing plate supports after burning in must be minimal, so that they can still be handled well and clamped easily in the printing apparatus. In the case of large format printing plate supports in particular, handling after burning in the photosensitive layer causes a problem. Finally, the printing plate must later, during use, survive as many printing cycles as possible so that the aluminium strip must have as high a flexural fatigue strength as possible. As well as these general requirements for the use of a printing plate support, for example European patent application EP 2 192 202 A1 investigates how an aluminium alloy strip can be set to a desired final strength, so that for example a coil set present in the aluminium strip can be eliminated again and at the same time high alternating bending cycles and good roughening properties can be provided. The object could be achieved here by the selection of the intermediate annealing thickness depending on the aluminium alloy composition.

DE 699 20 831 T2 describes a method for producing strips for lithographic printing plate supports in which a magnesium-free aluminium alloy is processed using cold rolling passes with pass reductions above 50%. Magnesium contents above 0.02% by weight are considered problematical in relation to recovery of the cold-rolled strip and the occurrence of excessively high strengths after cold rolling.

JP H11229101 also discloses the processing of magnesium-free aluminium alloys, which contain magnesium solely as a contaminant with levels of maximum 0.05% by weight. Higher magnesium contents are considered problematical.

In the production of aluminium strips for lithographic printing plate supports, today the main focus lies on aluminium alloys which contain magnesium. It has been found that magnesium offers advantages in particular in relation to fatigue strength when using the printing plate supports and the roughening of the printing plates. Therefore, magnesium is added to the aluminium alloy up to a precisely defined level.

A further focus of development is the production costs for the printing plate supports. By minimising the layer thickness of the photosensitive layer and the thicknesses of the support materials for the printing plates, i.e. the thickness of the aluminium strip for lithographic printing plate supports, to less than 0.3 mm, optimisation has already been achieved in relation to production costs in manufacture. In production of lithographic sheets, cold rolling is considered critical since it is the final process which determines the surface topography of the lithographic sheet. For cold rolling, working rolls achieving a so-called "mill finish" surface, i.e. polished working rolls, are used. Because of the very high requirements for the later surface quality, cold rolling frequently takes place on roll stands with a single cold rolling pass using the following steps:

uncoiling of the aluminium strip from a coil with an uncoiling reel,
rolling of the aluminium strip using a roll stand with a single cold rolling pass, and
coiling of the cold-rolled aluminium strip.

Because of the temperature development in cold rolling due to the forming energy applied, strips for lithographic printing plate supports are not usually rolled in roll stands with multiple passes. Maximum control of the individual cold rolling passes is desired. With a single cold rolling pass, it is sometimes however necessary to cool the strips in the coil after each cold rolling pass until they can be subjected to the next cold rolling pass. If the pass reduction in a cold rolling pass is too high, material can break away from the surface of the aluminium strip in regions, which leads to surface defects or a streaky appearance of the surface. Because of the risk of surface defects, the specialist sector has previously turned away from using high pass reductions above approximately 50% pass reduction per cold rolling pass in the case of magnesium-containing aluminium alloys. As a result, in typical production of lithographic printing plate supports with final thicknesses in the range 0.2 mm to 0.4 mm, previously at least four cold rolling passes were required.

On this basis, the object of the present invention is to provide a method for producing an aluminium strip for lithographic printing plate supports comprising magnesium-containing aluminium alloys, with which aluminium strips for lithographic printing plate supports can be produced with high quality and costs can be reduced at the same time.

BRIEF SUMMARY

According to a first teaching of the present invention, the above-mentioned object is achieved, for a method for production of an aluminium strip for lithographic printing plate supports, in that on cold rolling of the hot strip, the product of the relative final thicknesses of the aluminium strip after the first and after the second cold rolling pass of the aluminium strip amounts to 15% to 24%, preferably 17% to 22%.

The relative final thickness (b) after a cold rolling pass in this case means the thickness of the aluminium strip after a cold rolling pass in relation to the original thickness before the cold rolling pass as a percentage, i.e. the quotient of the resulting thickness and the starting thickness. The relative final thickness results from the pass reduction a of the respective cold rolling pass, which is also given as a percentage, as follows:

$$b_1=100\%-a_1.$$

The product P of the relative final thicknesses $b_1$ and $b_2$ of the first and second cold rolling passes then gives the relative final thickness in relation to the starting thickness before both cold rolling passes, and hence a measure for the thickness reduction of the aluminium strip during the first two cold rolling passes in relation to the starting thickness of the aluminium strip before cold rolling, as follows:

$$P=b_1\cdot b_2=(100\%-a_1)\cdot(100\%-a_2),$$

wherein $a_1$ and $a_2$ are the respective pass reductions of the first and second cold rolling passes as a percentage.

Optimising the first two cold rolling passes so that the product P of the relative final thicknesses after the first and after the second cold rolling pass lies between 15% and 24%, preferably 17% to 22%, has shown that, by targeted selection of higher pass reductionsin the first and/or second cold rolling pass, the thickness reduction of the aluminium strip in the first two cold rolling passes provides the possibility of omitting one complete cold rolling pass in the production process. Surprisingly, it was found that, despite the higher pass reductions, the surface quality still gives acceptable results in relation to streakiness, and hence one cold rolling pass can be reliably omitted. This result affects the production of lithographic sheets which previously required three, four or five cold rolling passes because of the hot strip final thickness and the final thickness after cold rolling. Thus, a method can be provided for production of an aluminium strip for lithographic printing plate supports which allows a reduction in production costs. Indeed, the reduction in production costs also applies to a roll stand with multiple pass reductions because of a reduced number of cold rolls to be used in the stand. The economic effect is however greater if a roll stand with just one cold rolling pass is used. These roll stands, as already stated, are normally used in cold rolling of aluminium strips in order to achieve very high surface qualities. In this case, the hot-rolled aluminium strip preferably undergoes the following working steps while observing the requirements for the product of the first two cold rolling passes:

- uncoiling of the aluminium strip from a coil with an uncoiling reel,
- rolling of the aluminium strip using a roll stand with a single cold rolling pass, and
- coiling of the cold-rolled aluminium strip.

A preferred embodiment of the method according to the invention is provided in that on cold rolling of the hot strip, the product of the relative final thicknesses of the aluminium strip after the first and after the second cold rolling pass is preferably 17% to 20%. This achieves a good compromise in relation to process reliability for the provision of high surface qualities and the possibility of omitting a cold rolling pass.

According to a further embodiment of the method, production of an aluminium strip with a final thickness of 0.1 mm to 0.5 mm after cold rolling may take place in two or three cold rolling passes if the hot strip final thickness amounts to 2.3 mm to 3.7 mm, preferably 2.5 mm to 3.0 mm. Below 2.3 mm, there is a risk that on hot strip production, the hot strip can collapse during coiling. Above 3.7 mm hot strip final thickness, the pass reductions for the first or second cold rolling pass would have to be set too high in order to reduce the number of cold rolling passes. If the cold rolling pass reduction is too high, there is not only a risk of surface defects on the aluminium strip but also a risk of damaging the cold roll itself. A hot strip final thickness from 2.5 mm to 3.0 mm prevents both collapse of the hot strip and the use of excessively high pass reductions in cold rolling.

In order to achieve the relative final thicknesses of the aluminium strip of 15% to 24%, preferably 17% to 22%, during the first two cold rolling passes while reliably avoiding surface defects and danger to the cold roll, according to a further embodiment of the method, on cold rolling, preferably the first cold rolling pass is performed with a pass reduction of maximum 65%, preferably maximum 60%. It has been found that above a pass reduction of 65% in the first cold rolling pass after hot rolling, the risk of surface defects rises significantly. Preferably, with a maximum 60% pass reduction in the first cold rolling pass, even more homogenous surfaces are achieved in the aluminium strip.

In relation to the second cold rolling pass, it was found that this preferably has a pass reduction of maximum 60% in order to reliably avoid corresponding defects in the final product process. The second cold rolling pass is therefore more critical in relation to surface quality.

Both the first and the second cold rolling pass preferably have pass reductions of over 50%, since in this way the pass reductions for achieving the desired relative final thicknesses can be better distributed between the two cold rolling passes. In total then, in both cold rolling passes, no maximum pass reductions are required.

According to a further embodiment of the method according to the invention, three cold rolling passes to final thickness are performed, wherein the final thickness of the aluminium strip after cold rolling is 0.2 mm to 0.4 mm. For these final thicknesses, previously usually at least four cold rolling passes were required. In particular for final thicknesses from 0.2 mm to 0.4 mm, thus a method may be provided which has reduced costs as well as an adequate surface quality.

Preferably, according to a further embodiment of the method according to the invention, four cold rolling passes to final thickness are performed, wherein the final thickness of the aluminium strip after cold rolling is less than 0.2 mm. For strips for lithographic printing plate supports with final thicknesses from 0.1 mm to less than 0.2 mm, previously five cold rolling passes were required. Here again, the method according to the invention may contribute to reducing costs.

A further potential for saving production costs may be achieved if, during cold rolling, no intermediate annealing is performed. It has been found that, despite omitting a cold rolling pass, aluminium strips in state H19 may be provided, the surface quality and further mechanical properties of which are adequate for the production of lithographic printing plate supports. As an alternative to the production of aluminium strips in state H19, aluminium strips with intermediate annealing in state H18 may be produced according to the invention. The third or fourth cold rolling pass, preferably the last cold rolling pass of the cold rolling, preferably has a maximum pass reduction of 52%, so that the third or fourth or last cold rolling pass—which has a greater influence on the surface—has as little influence as possible on the surface quality of the aluminium strip.

The cost-efficient production method is performed according to the invention with an aluminium strip consisting of an aluminium alloy with the following alloy constituents in % by weight:

0.05%≤Si≤0.25%, 0.2%≤Fe≤1%, preferably 0.3%≤Fe≤1%, particularly preferably 0.3%≤Fe≤0.6% or 0.4%≤Fe≤0.6%, Cu maximum 400 ppm, preferably maximum 100 ppm, Mn≤0.30%, optionally 30 ppm to 800 ppm, 0.10%≤Mg≤0.50%, 0.15%≤Mg≤0.45%, preferably 0.24%≤Mg≤0.45%, Cr maximum 100 ppm, preferably maximum 50 ppm, Zn≤0.05%, preferably 50 ppm to 250 ppm, Ti<0.030%, the remainder aluminium and unavoidable impurities individually at most 0.03%, in total at most 0.15%.

It has been found that aluminium strips with the given composition of the aluminium alloy are particularly well suited for the method according to the invention. Experiments with the alloy specification have shown that on use of the method according to the invention, a sufficiently good surface can be provided which has no tendency to streakiness yet allows the omission of one cold rolling pass. It is assumed that this result is attributable amongst others to the overall combination of the alloy composition. The selected range of the alloy constituent silicon, from 0.05% by weight to 0.25% by weight, guarantees that on electrochemical roughening, a high number of sufficiently deep depressions can be made in the aluminium strip to guarantee an optimum adhesion of the photosensitive layer. The iron content of 0.2%≤Fe≤1%, preferably 0.3%≤Fe≤1%, particularly preferably 0.3%≤Fe≤0.6% or 0.4%≤Fe≤0.6%, in combination in particular with the manganese proportion of up to maximum 0.30% by weight, ensures an aluminium alloy which is as heat-resistant as possible and which, after burning in the photosensitive layer, only has a slight loss of strength in relation to limit of elasticity and tensile strength. The copper content of maximum 400 ppm, preferably maximum 100 ppm, particularly preferably maximum 50 ppm, is particularly low since copper has a negative effect on the roughening behaviour of the aluminium strip. The preferred manganese content of up to 0.30% by weight, preferably 30 ppm to 800 ppm—as already stated—in combination with the iron content guarantees an improved heat resistance of the aluminium strip after a burn-in process and has a positive influence on the flexural fatigue strength of the aluminium strip. The magnesium content of 0.10% to 0.5% by weight, preferably 0.15% to 0.45% by weight, particularly preferably from 0.24% to 0.45% by weight, leads to a strength increase on cold rolling because of the strain hardening, and also offers the advantage of good flexural fatigue strength even in the as-rolled state. The aluminium alloy also preferably contains almost no chromium. The chromium content is limited to maximum 100 ppm, preferably maximum 50 ppm. Higher chromium contents have proved to have a negative effect on the roughening properties of the aluminium strip during electrochemical roughening. Zinc lowers the electrochemical potential of the aluminium alloys of the aluminium strip so that the electrochemical roughening is accelerated. Zinc is therefore present in the aluminium alloy with a concentration of up to maximum 500 ppm. Higher zinc contents again have a negative influence on the roughening properties of the aluminium strip. The presence of zinc with a content of 50 ppm to 250 ppm reliably leads to an accelerated roughening of the aluminium strip without negative effects on the surface. The aluminium strip according to the invention is also almost free from titanium. It contains less than 0.03% by weight titanium which, above this limit value, negatively affects the properties of the aluminium alloys in electrochemical roughening. In addition, unavoidable impurities may be present in the aluminium alloy of at most 0.03% by weight, and in total at most 0.15% by weight, without negatively influencing the properties of the aluminium alloy strip in the specified production process.

According to a next embodiment, if the aluminium alloy has a magnesium content of 0.26% to 0.35% by weight, a very good compromise can be achieved between improved fatigue strength properties of the printing plate support, good roughening behaviour and reduced production costs.

BRIEF DESCRIPTION OF THE DRAWINGS

The invention will now be explained in more detail below with reference to exemplary embodiments in conjunction with the drawing. The drawing shows in.

DETAILED DESCRIPTION

Figure 1:
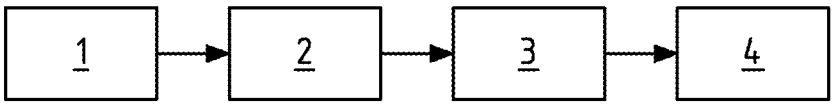
FIG. 1 shows a diagrammatic view, the basic method steps for production of an aluminium strip for lithographic printing plate supports.

FIG. 1 shows diagrammatically the various method steps in the production of an aluminium strip for lithographic printing plate supports. Firstly, according to step 1, the aluminium alloy is cast into a rolling ingot. In step 2, the rolling ingot is subjected to homogenisation, wherein the rolling ingot is heated to temperatures from 450° C. to 600° C. for a duration of at least 1 hour. The homogenised rolling ingot is prepared for hot rolling and then hot-rolled at temperatures of over 280° C. At the start of the hot rolling, the temperature of the ingot is around 450° C. to 550° C. The hot rolling final temperature is usually from 280° C. to 350° C. The hot strip final thickness may lie between 2 mm and 9 mm; however, hot strip thicknesses from 2.3 mm to 3.7 mm are preferred. The hot strip is sent for cold rolling in step 4. In cold rolling, the hot strip is cold-rolled to final thickness. Cold rolling and in particular the last cold rolling pass determine the surface properties of the cold-rolled aluminium strip, since the surface topography of the cold roll is directly transferred to the cold-rolled aluminium strip. During the rolling pass, in cold rolling, defects can occur which are then transferred to the surface or remain directly visible on the surface. Because of this circumstance, previously only moderate pass reductions of at most 50% for the individual cold rolling step were provided, since it is known that if the pass reduction is too high, there is either a risk of damaging the cold rolls or regions of the surface of the aluminium strip are broken away, leading to surface defects. In view of the high requirements for homogeneity of the surface of lithographic printing plate supports, surfaces with uneven appearance, for example streaky surfaces, are unacceptable.

Cold rolling according to step 4 may take place both with and without intermediate annealing. Intermediate annealing is performed at temperatures of 230° C. to 490° C. for at least 1 hour in a chamber furnace, or continuously in a continuous belt furnace for at least 10 seconds, usually before the last cold rolling pass. Intermediate annealing allows the final strength of the aluminium strip for lithographic printing plate supports to be set within certain ranges before the last cold rolling pass. However, intermediate annealing also entails costs, so particularly cost-efficient production is preferably performed without intermediate annealing.

Figure 2:
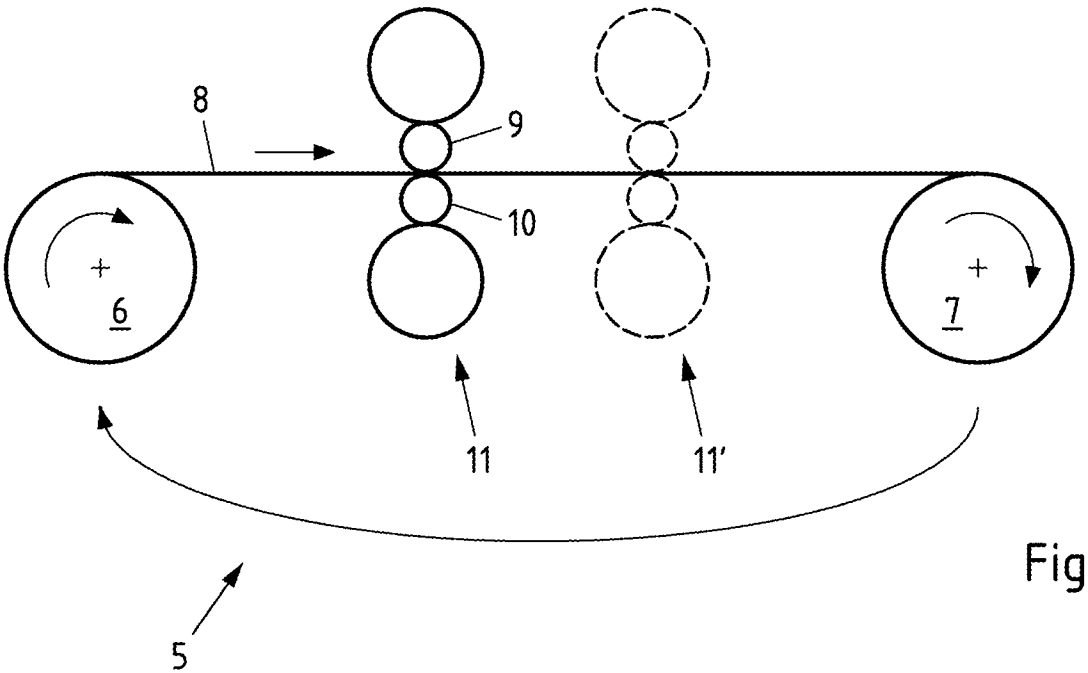
FIG. 2 shows a diagrammatic sectional view, the performance of a cold rolling pass with one or more cold rolling passes.

Usually, for cold rolling, rolls stands are used which perform a single cold rolling pass, and the aluminium strip is rewound immediately after the cold rolling pass. FIG. 2 shows a corresponding roll stand 5 which has an uncoiling reel 6, a coiling reel 7, and a roll arrangement 11 with two working rolls 9 and 10. FIG. 2 shows as an example a quarto roll stand. The roll arrangement may also be configured as a duo, quarto or sexto roll stand. An additional roll arrangement 11' is also indicated, so that after passing through the roll arrangement 11, the strip 8 may undergo a further rolling pass in the roll arrangement 11', i.e. in total a multiple pass. Usually however, as already stated, individual cold rolling passes are performed and the aluminium strip 8 is then coiled into a coil on the coiling reel 7. In some cases, after cooling of the aluminium strip 8 in the coil after the cold rolling pass, the aluminium strip may be supplied to a further cold rolling pass.

Figure 3A:
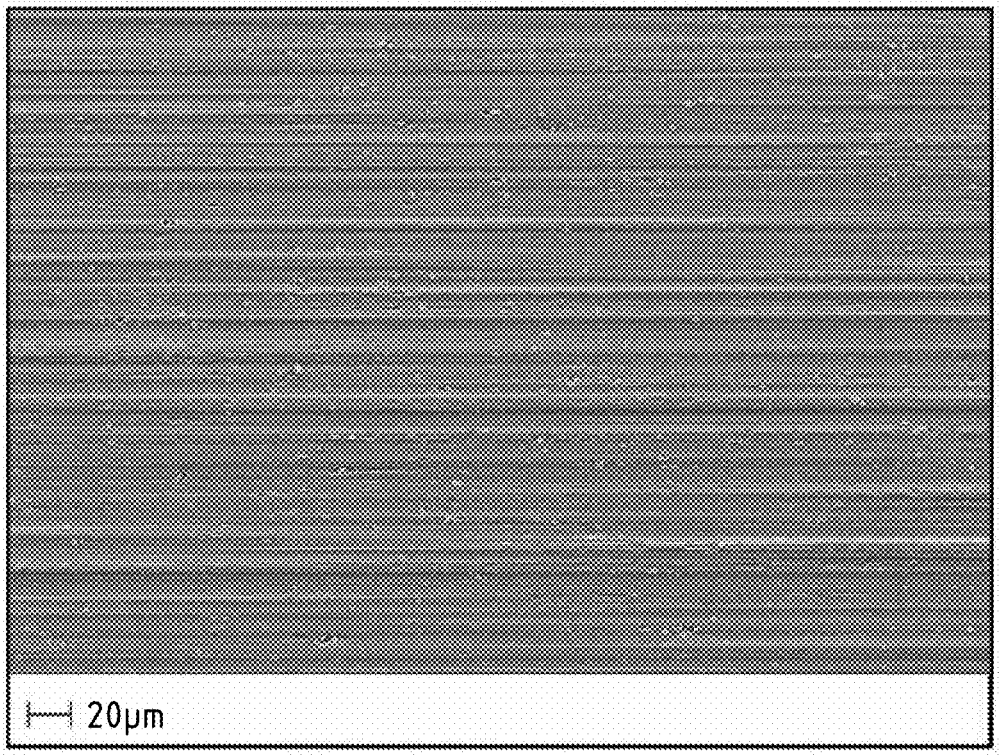
FIGS. 3*a*)-3*c*) show a comparison of SEM images of surface regions, which are considered good and poor, of an aluminium strip for lithographic printing plate supports.

FIGS. 3*a*) to 3*c*) show scanning electron microscope images of cold-rolled aluminium strips for lithographic printing plate supports. FIG. 3*a*) shows, at the same magnification as FIG. 3*b*), a strip considered to be inconspicuous from the surface. The roll webs of the ground rolls which have been imprinted into the aluminium strip are clearly evident. However, almost no structures are present perpendicular to the roll direction, so the overall impression of the surface is considered non-streaky.

Figure 3B:
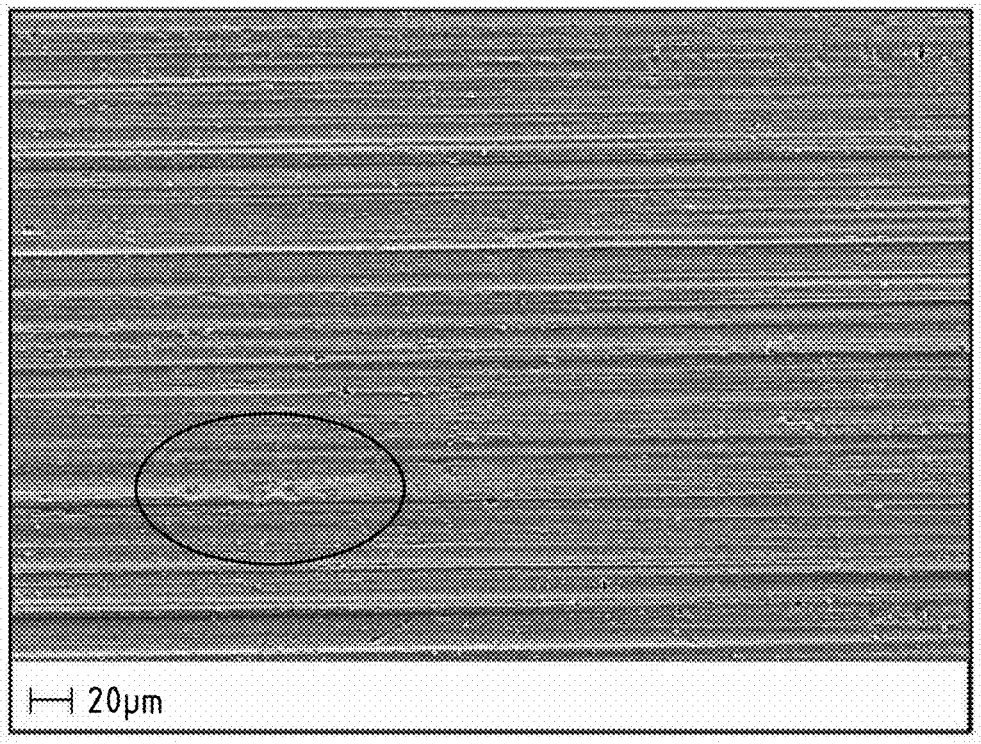
Figure 3C:
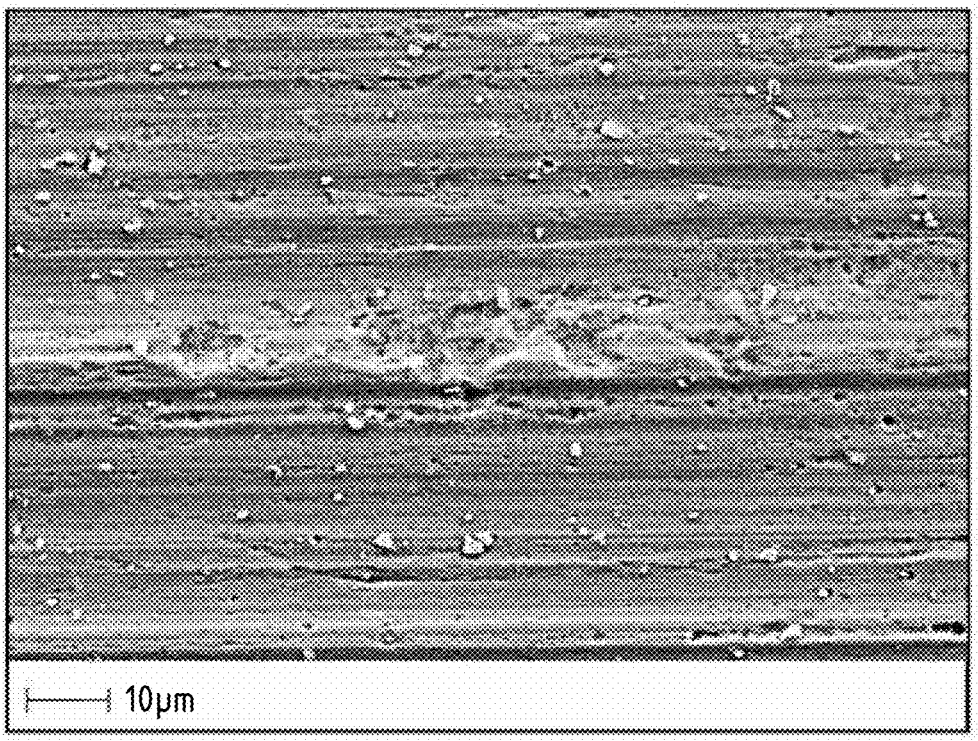

FIGS. 3*b*) and 3*c*) in contrast show a surface region of an aluminium strip which is regarded as uneven, which leads to a streaky appearance of the aluminium strip. A corresponding strip would not meet the surface requirements for lithographic printing plate supports. FIGS. 3*b*) and 3*c*) show surface defects, in particular magnified in FIG. 3*c*), which have regions extending transversely to the roll direction in which the material has been removed from the surface of the strip. It is assumed that these defects are attributable to the cold rolling. The width of the problematic region is around 20 μm perpendicular to the rolling direction and is evident on a visual inspection.

Aluminium strips were produced from six different aluminium alloys A to H using the method steps 1 to 3 explained above and depicted in FIG. 1. The aluminium strips were produced without intermediate annealing on cold rolling, wherein the hot strip final thickness and the pass reductions on cold rolling were varied. The aluminium alloys differ in particular in the differing contents of silicon, iron, manganese and magnesium. The different alloy compositions are shown in Table 1 with their alloy constituents as percentages by weight. In addition, all alloys contained chromium at less than 50 ppm, and unavoidable impurities individually at most 0.03% by weight and in total at most 0.15% by weight.

TABLE 1

| Alloy wt % | Si | Fe | Cu | Mn | Mg | Zn | Ti |
|---|---|---|---|---|---|---|---|
| A | 0.092 | 0.438 | 0.0019 | 0.039 | 0.262 | 0.0114 | 0.0051 |
| B | 0.084 | 0.420 | 0.0019 | 0.255 | 0.244 | 0.0124 | 0.0051 |
| C | 0.077 | 0.435 | 0.0018 | 0.040 | 0.264 | 0.0093 | 0.0072 |
| D | 0.128 | 0.429 | 0.0016 | 0.040 | 0.285 | 0.0087 | 0.0068 |
| E | 0.085 | 0.374 | 0.0016 | 0.003 | 0.196 | 0.0090 | 0.0050 |
| F | 0.116 | 0.438 | 0.0015 | 0.040 | 0.324 | 0.0136 | 0.0075 |
| G | 0.119 | 0.436 | 0.0010 | 0.040 | 0.323 | 0.0137 | 0.0058 |
| H | 0.085 | 0.374 | 0.0016 | 0.003 | 0.196 | 0.0090 | 0.0050 |

The hot strip final thickness of the produced aluminium strips varied from 2.3 mm to 3.0 mm, and from the hot strips of varying thickness, aluminium strips for lithographic printing plate supports were produced by cold rolling without intermediate annealing and with a final thickness from 0.274 mm to 0.285 mm. The pass reductions of the first and second cold rolling passes were selected such that, starting from the hot strip final thickness, a maximum of three cold rolling passes to final thickness were required, wherein the last cold rolling pass had a maximum pass reduction of 51%. As Table 2 shows, the product P of the relative final thicknesses after the first and after the second cold rolling passes, because of the pass reductions in the first two cold rolling passes, was 18.57% to 21.74%. This means that because of the first two cold rolling passes, the strip was rolled to an intermediate thickness of 18.57% to 21.74% of the hot strip final thickness.

Table 2 shows the exemplary embodiments according to the invention and the associated pass reductions, and the values for the product of the relative end thicknesses after the first and second cold rolling passes.

TABLE 2

| No. | Alloy | Hot strip final thickness [mm] | 1st cold rolling pass (a1) [%] | 2nd cold rolling pass (a2) [%] | Product P [%] | 3rd cold rolling pass [%] | Final thickness [mm] |
|---|---|---|---|---|---|---|---|
| 1 | A | 2.3 | 57 | 50 | 21.74 | 45 | 0.275 |
| 2 | B | 2.3 | 57 | 50 | 21.74 | 45 | 0.275 |
| 3 | C | 2.8 | 57 | 53 | 20.00 | 51 | 0.274 |
| 4 | C | 2.8 | 57 | 53 | 20.00 | 51 | 0.274 |
| 5 | C | 2.8 | 57 | 53 | 20.00 | 51 | 0.274 |
| 6 | D | 2.8 | 57 | 53 | 20.00 | 51 | 0.274 |
| 7 | D | 2.8 | 57 | 53 | 20.00 | 51 | 0.274 |
| 8 | D | 2.8 | 57 | 53 | 20.00 | 51 | 0.274 |
| 9 | D | 2.8 | 57 | 53 | 20.00 | 51 | 0.274 |
| 10 | E | 2.8 | 50 | 60 | 20.00 | 51 | 0.275 |
| 11 | F | 2.8 | 64 | 48 | 18.57 | 45 | 0.285 |
| 12 | F | 2.8 | 64 | 48 | 18.57 | 45 | 0.285 |
| 13 | G | 2.8 | 64 | 48 | 18.57 | 45 | 0.285 |
| 14 | G | 2.8 | 64 | 48 | 18.57 | 45 | 0.285 |
| 15 | H | 3.0 | 60 | 53 | 18.67 | 51 | 0.275 |

In order to examine the surfaces in relation to their suitability for lithographic printing plate supports, two tests were developed to evaluate the streakiness S of the surfaces of the cold-rolled aluminium strips. The test methods serve to highlight possible streakiness defects by surface preparation and make these more easily identifiable visually.

In the so-called "K test", the grain streakiness of the aluminium alloy strips was investigated. For this, the surfaces must be specifically prepared to expose the grain structure. Firstly, rectangular specimens 250 mm long in the roll direction and 45 mm wide were cut from the strips. The specimens were taken both from the edge and from the centre of the strips in relation to the roll direction. The K test aims to reveal whether, because of the grain distribution, a streakiness effect can be seen in the surface.

The specimens thus cut out were ground initially for 60 seconds using an orbital sander, wherein the oscillating sander was wrapped in a damp cloth and scouring agent was used to polish the specimens. The scouring agent used here may be a simple domestic scouring agent. After rinsing the surface with water, the specimens were immersed in a 30% soda lye at a temperature of 60° C. for 15 seconds and then rinsed with water. Macro etching then took place in a macro etching solution. This consists of:

40 ml water, 300 ml HCl with a concentration of 37%, 133.6 ml $HNO_3$ with 65% concentration, and 43.34 ml of 40% hydrofluoric acid.

The macro etching took place at around 25 to 30° C. for 30 seconds. The specimen was then rinsed with water again and immersed for 15 seconds in the 30% soda lye at a temperature of 60° C. Subsequent neutralisation took place with a solution of 40.5 ml of 85% phosphoric acid and 900 ml water at room temperature for around 60 seconds. The specimen was then rinsed with water and dried at room temperature. After drying, the specimens were visually assessed for streakiness. Reference samples with value numbers from 1 to 10 were used for assessment of the streakiness in the K test. A comparison was made between the reference sample and the specimen using the human eye. The specimens were then assigned the value number of the nearest reference sample. The value number of 10 here means not streaky. The value number of 1 corresponds to a streaky appearance. This streakiness, as already stated, is caused by the grain distribution of the aluminium strips and can be easily assessed using this test.

As evident from Table 3, the exemplary embodiments with high pass reductions of 64% in the first cold rolling pass indeed show good values in relation to the value number of the K test. Their surface as a whole however is somewhat poorer than the exemplary embodiments with lower pass reductions in the first cold rolling pass.

It was found that, in addition to the established K test, a further test must be used since in particular the surface defects from cold rolling, shown in FIGS. 3*b*) and 3*c*), were evidently not revealed by the previous K test. This is shown by the results of the newly developed test.

An additional pickling test was developed. The specimen was a rectangular cut-out of 250 mm edge length in the rolling direction and 80 mm edge length perpendicular to the rolling direction, which was first subjected to degreasing in a watery solution with a degreasing medium, here under the brand name Nabuclean 60S, at 60° C. for 10 seconds. The concentration of the degreasing medium is 15 g/l. After rinsing with water, the specimen was immersed in a soda lye solution and etched for around 10 seconds at 50° C. The soda lye concentration was 50 g/l. Then rinsing with water took place followed by drying in the drying cabinet at around 70° C. After drying, the specimens were evaluated, wherein again reference samples were used to which values from 0 to 5 were assigned, wherein the value 0 is considered not streaky and the value 5 refers to a surface regarded as streaky. In the pickling test, the specimens were compared with reference samples and evaluated before and after pickling.

No surfaces with value number 5 were found in the pickling test. In experiments 11 to 14, a cold rolling pass reduction of 64% was used in the first cold rolling pass, which had a significant effect on the surface quality in the evaluation of the specimens in the pickling test, both before performance of the pickling test and after pickling. In comparison with experiments 1 to 10 produced with the lower pass reductions, experiments 11 to 14 showed results with value numbers 3-4 and 3 in the pickling test. These indicate a poorer surface quality in this test. A pass reduction of 65% in the first cold rolling pass must therefore be regarded as the maximum. Any increase above this level, according to our present knowledge, leads to significant disadvantages in relation to surface quality.

All other specimens showed values of 2-3 or 3 after the pickling test and hence sufficiently good surface qualities. This means that as the pass reductions in the first cold rolling pass reduce, the surface quality in the pickling test increases. In general, it was found that pass reductions of at most 60% in the first and second cold rolling passes, despite the omission of one cold rolling pass, gave good surfaces in the pickling test.

Thus, for various aluminium alloys which contain magnesium with different hot strip final thicknesses, it could be shown that a cold rolling pass could be omitted in the production of cold-rolled aluminium strips for lithographic printing plate supports without influencing the surface quality too greatly. As a result, therefore, a production method can be provided which, by saving one cold rolling pass, may provide cheaper aluminium strips for lithographic printing plate supports.

TABLE 3

| | | K Test | | Pickling test | |
|---|---|---|---|---|---|
| No. | Alloy | Edge | Centre | before | after |
| 1 | A | 5 | 3-4 | 1 | 2-3 |
| 2 | B | 4-5 | 4 | 1 | 3 |
| 3 | C | 2-3 | 2 | 1 | 2-3 |
| 4 | C | 2-3 | 2-3 | 2 | 2-3 |
| 5 | C | 3 | 3 | 0 | 3 |
| 6 | D | 3-4 | 3 | 2 | 2-3 |
| 7 | D | 2-3 | 3 | 2 | 2-3 |
| 8 | D | 3 | 3-4 | 0 | 3 |
| 9 | D | 4 | 3-4 | 0 | 2-3 |
| 10 | E | 5 | 1-2 | 1-2 | 2-3 |
| 11 | F | 7 | 3-4 | 3 | 3 |
| 12 | F | 6-7 | 4 | 3 | 3 |
| 13 | G | 7 | 4-5 | 2 | 3-4 |
| 14 | G | 7 | 4-5 | 3 | 2-3 |
| 15 | H | 5-6 | 2 | 1-2 | 2-3 |

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for production of an aluminium strip for lithographic printing plate supports from an aluminium alloy, wherein the aluminium alloy of the aluminium strip for lithographic printing plate supports comprises the following alloy constituents in % by weight:

0.05%≤Si≤0.25%,
0.2%≤Fe≤1%,
Cu max. 400 ppm,
Mn≤0.30%,
0.10%≤Mg≤0.50%,
Cr≤100 ppm,
Zn≤500 ppm,
Ti<0.030%, the remainder aluminium and unavoidable impurities individually at most 0.03%, in total at most 0.15%, with at least the following steps:

casting of a rolling ingot from an aluminium alloy,
homogenising of the rolling ingot,
hot rolling of the rolling ingot to a hot strip thickness, and
cold rolling of the hot strip to final thickness, wherein the final thickness of the aluminium strip after cold rolling is between 0.1 mm and 0.5 mm, wherein on cold rolling, the product of the relative final thicknesses of the aluminium strip from a first and second cold rolling pass is 17% to 22%.

2. The method according to claim 1, wherein the hot strip thickness is 2.3 mm to 3.7 mm.

3. The method according to claim 1, wherein on cold rolling, the first cold rolling pass is carried out with a pass reduction of maximum 65%.

4. The method according to claim 1, wherein the second cold rolling pass has a pass reduction of maximum 60%.

5. The method according to claim 1, wherein three cold rolling passes to final thickness are performed, and the final thickness of the aluminium strip after cold rolling is 0.2 mm to 0.4 mm.

6. The method according to claim 1, wherein four cold rolling passes to final thickness are performed, and the final thickness of the aluminium strip after cold rolling is less than 0.2 mm.

7. The method according to claim 1, wherein, during cold rolling, no intermediate annealing is performed.

8. The method according to claim 1, wherein a third or fourth cold rolling pass has a maximum pass reduction of 52%.

9. The method according to claim 1, wherein the aluminium alloy of the aluminium strip for lithographic printing plate supports has a magnesium content of 0.15%≤Mg≤0.45%.

10. The method according to claim 1, wherein the aluminium alloy of the aluminium strip for lithographic printing plate supports has a magnesium content of 0.24% to 0.45% by weight.

11. The method according to claim 1, wherein the hot strip thickness is from 2.5 mm to 3.0 mm.

12. The method according to claim 1, wherein the aluminium alloy of the aluminium strip for lithographic printing plate supports has a magnesium content of 0.26% to 0.35% by weight.

* * * * *